US010774411B2

(12) United States Patent
López et al.

(10) Patent No.: US 10,774,411 B2
(45) Date of Patent: Sep. 15, 2020

(54) NICKEL-BASED ALLOY TUBES AND METHOD FOR PRODUCTION THEREOF

(71) Applicants: TUBACEX INNOVACION A.I.E., Derio-Vizcaya (ES); IBF S.P.A., Cornate d'Adda (MB) (IT)

(72) Inventors: Alejandra López, Derio-Vizcaya (ES); Urbano Faina, Cornate d'Adda (IT)

(73) Assignees: TUBACEX INNOVACION A.I.E., Derio-Vizcaya (ES); IBF S.P.A., Cornate d'Adda (MB) (IT)

( * ) Notice: Subject to any disclaimer, the term of this patent is extended or adjusted under 35 U.S.C. 154(b) by 27 days.

(21) Appl. No.: 16/074,531

(22) PCT Filed: Feb. 2, 2017

(86) PCT No.: PCT/EP2017/052299
§ 371 (c)(1),
(2) Date: Aug. 1, 2018

(87) PCT Pub. No.: WO2017/134184
PCT Pub. Date: Aug. 10, 2017

(65) Prior Publication Data

US 2019/0040509 A1 Feb. 7, 2019

(30) Foreign Application Priority Data

Feb. 2, 2016 (EP) ..... 16382043

(51) Int. Cl.

| | |
|---|---|
| ***C22F 1/10*** | (2006.01) |
| ***C21D 9/14*** | (2006.01) |
| ***C22C 19/00*** | (2006.01) |
| ***C21D 8/10*** | (2006.01) |
| ***B21B 3/00*** | (2006.01) |
| *C22C 19/05* | (2006.01) |

(52) U.S. Cl.
CPC ..... *C22F 1/10* (2013.01); *B21B 3/00* (2013.01); *C21D 8/10* (2013.01); *C21D 9/14* (2013.01); *C22C 19/00* (2013.01); *C22C 19/05* (2013.01)

(58) Field of Classification Search
CPC ..... C22F 1/10
See application file for complete search history.

(56) References Cited

U.S. PATENT DOCUMENTS

| | | | |
|---|---|---|---|
| 4,876,870 | A | 10/1989 | Rantanen |
| 8,479,549 | B1 | 7/2013 | Fonte |
| 2014/0311633 | A1 | 10/2014 | Cribb et al. |

FOREIGN PATENT DOCUMENTS

| | | |
|---|---|---|
| EP | 2415883 | 2/2012 |
| WO | 2010/024829 | 3/2010 |

OTHER PUBLICATIONS

Eremin, E. N., Yu O. Filippov, and A. E. Eremin. "Promising method of producing cast billets from superalloys." Russian metallurgy (Metally) Dec. 2010 (2010): 1131-1135.*

* cited by examiner

*Primary Examiner* — Jessee R Roe
(74) *Attorney, Agent, or Firm* — Carmody Torrance Sandak & Hennessey LLP

(57) ABSTRACT

A method for producing a tube of a nickel-based alloy tube which comprises the steps of hot working a nicked-based alloy casting into a pretubular-shaped workpiece or into a cylindrical bar, trepanning the cylindrical bar or machining an inner diameter of the pretubular-shaped workpiece to obtain a tubular workpiece, and cold working the tubular workpiece. The hot working comprises one of: rolling, forging, and a combination thereof. The cold working comprises flow forming or pilgering. A nickel-based alloy tube produced with the method comprises an outer diameter greater than or equal to 60.3 mm, an average wall thickness greater than or equal to 2.8 mm, and less than or equal to 70 mm.

18 Claims, 3 Drawing Sheets

NICKEL-BASED ALLOY TUBES AND METHOD FOR PRODUCTION THEREOF

TECHNICAL FIELD

The present invention relates to the production of tubes made of nickel-based alloy, particularly alloys as Alloy 625 to obtain high strength and fine and homogeneous microstructure and the method for production thereof.

STATE OF THE ART

The pipelines for transferring substances like, for example, oil&gas extracted from a well are usually exposed to severe conditions in the form of, for instance, high levels of pressure and stresses. The tubes that are used in deep wells with HPHT (high pressure and high temperature) conditions require high strength materials with enhanced properties such as resistance to corrosion and microstructure homogeneity, or the tubes may otherwise fail.

In this regard, some alloys that are well-suited for this kind of environments are those including nickel. Among the several available nickel-based alloys, the alloy 625 is particularly convenient for materials in HPHT conditions, however alloy 625 features low cold forming capabilities which makes the production of long tubes rather difficult.

The interest in providing high strength tubes, including those made of nickel-based alloys, is shown, for instance, in U.S. Pat. No. 8,479,549 B1, which relates to a method of producing cold-worked centrifugal cast tubular products featuring high strength. The tubular workpiece casted of a corrosion resistant alloy, has material from its inner diameter removed, and then a metal forming process reduces the walls of the tubular workpiece. When the metal forming process is flowforming, the walls of the workpiece may be reduced with several passes because the workpiece is not able to process large reductions in one pass, hence the progressive reduction of walls may be provided with subsequent flowforming passes.

Since the yield strength of the tubes produced is related to the reduction achieved during the cold working process, the yield strength is generally bounded to the degree of reduction achievable by the methods of producing tubes. Therefore, it would be advantageous to produce tubes in which large reductions may be applied so that the tubes feature a high yield strength and a homogeneous microstructure, making them particularly suitable for environments characterized by HPHT conditions.

DESCRIPTION OF THE INVENTION

The tubes made of nickel-based alloys and method for production thereof disclosed in the present invention intends to solve the shortcomings of the tubes and methods of the prior art.

A first aspect of the invention relates to a method for producing a tube of a nickel-based alloy. The method comprises the steps:

(a) hot working a nickel-based alloy casting into a pretubular-shaped workpiece or into a cylindrical bar;

(b) trepanning the cylindrical bar or machining an inner diameter of the pretubular-shaped workpiece to obtain a tubular workpiece;

(c) cold working the tubular workpiece.

A pretubular-shaped workpiece is a tube or a workpiece with a tubular shape that is machined or conformed to obtain the final dimensions of the tube, whereas a cylindrical bar is a bar with a rounded cross-section that is, for example, circular or oval.

A hot working process plastically deforms a nickel-based alloy casting into a pretubular-shaped workpiece or a cylindrical bar while changing the microstructure and, therefore, the properties of the casting.

The shape of the nickel-based alloy casting may resemble, for example, but not limited to, an ingot or a bar. The shape may feature regular or irregular geometries such as, for instance, rectangular prisms, hexagonal prisms, round prisms, cylinders, etc.

In order for the process to be effectively applied to the casting, the nickel-based alloy casting is heated to a temperature preferably higher than its recrystallization temperature. The casting is then plastically deformed so that its mechanical properties are enhanced for the production of tubes characterized by a high strength, an elongated shape and reduced (i.e. thin) walls.

The internal structure of the casting typically features variable cavities, sizes of grains and segregations in the nickel-based alloy that appear during its casting. Thus, while it is casted, the different temperatures present throughout the material, together with the effect of the gravity, generate a heterogeneous internal structure in the form of said cavities, grains with different size and shape, and macro-scale and/or micro-scale segregation of alloying elements.

The hot working process homogenizes the microstructure of the resulting workpiece or bar. Therefore, with hot working, the casting is compacted internally causing changes in the resulting microstructure. Particularly, the workpiece or bar may recrystallize, that is, a new inner structure of crystals may be formed, generating fine grains that improve the mechanical properties as the internal stresses disappear due to the deformation. A consequence of the hot working is that the workpiece or bar features a larger ductility and, at the end, higher cold reductions can be applied in a single step.

The effect of the hot working process on the microstructure may be estimated using a deformation ratio. The ratio is defined as the original cross-section of the casting or workpiece divided by its cross-section after hot working. Reaching a deformation ratio of about 3 or greater may be advantageous in that an increase in the toughness and tensile strength of the workpiece or bar, in the longitudinal direction, is achieved.

A drilling or trepanning process removes a part of the bar with a hole that, generally, goes through the whole bar. The part removed may substantially correspond to a central part of at least one face or side of the bar. In the case of the pretubular-shaped workpiece, its inner diameter is machined.

After trepanning the bar or machining the inner diameter of the pretubular-shaped workpiece, a tubular workpiece is obtained.

A cold working process reduces the section or area of the tubular workpiece so as to lengthen the tube to be produced. The process, thus, redistributes the material: the part of the alloy that is removed from the workpiece in the radial direction, which usually corresponds to the walls of the produced tube, is added to the workpiece in the axial direction. The cross section is reduced thereby elongating the pipe or tube.

Since the workpiece or bar has been hot-worked, its rather fine internal structure provides better conditions—compared to the conditions of the casting prior to the hot working—for the cold working. Consequently, the degree of reduction may be greater than if no hot working is performed. The reduction is directly related to the attainable yield strength and length of the tube.

In preferred embodiments of the invention, the method further comprises (d) casting the nickel-based casting. Further, in these embodiments, casting the nickel-based casting—step (d)—is performed prior to hot working the nickel-based alloy casting into a cylindrical bar or pretubular-shaped workpiece—step (a).

The casting that is hot-worked in some embodiments is casted by melting the nickel-based alloy and pouring it in a mold. The dimensions of the produced casting, both in terms of its length and section—or diameter—, determine the maximum dimensions of the tube that may be produced since the nickel-based alloy in the casting will be redistributed so as to form the tube, even though a part of said alloy may be lost during the production of the tube, for instance, while trepanning, machining or cold working the workpiece. Thus, the amount of alloy necessary for the casting varies in accordance with the dimensions of the tube to be produced.

In preferred embodiments, the nickel-based alloy is an alloy at least comprising nickel and chromium. Also, in preferred embodiments, the nickel-based alloy is alloy 625.

With some nickel-based alloys, for example alloy 625—corresponding to the UNS N06625 specification—, the tubes produced with the method described herein may feature high yield strength. So, in addition to the high yield strength achieved due to the method for producing a tube disclosed herein, the tube may be characterized by an even greater yield strength owing to the characteristics of alloy 625.

In preferred embodiments of the invention, hot working comprises one of: rolling, forging, and a combination thereof.

Rolling the nickel-based alloy casting homogenizes its inner structure in terms of the grain size, porosity, cavities, among others. The rolling mills plastically deform the casting, which typically features grains that are larger in its interior than on its surface—the part in contact with the casting mold—. The rolled workpiece may feature many different shapes such as, for example, cylindrical, rectangular, sheet-like, among others. Continuous or reversible rolling mills known in the art may be used, for example, for plastically deforming a casting like, for instance, a bar or an ingot.

The nickel-based alloy casting may also be forged during the hot working step, in which case the casting may be held—although not necessarily—with pliers, bars, or the like, and a hammer or a die delivers blows so as to deform it. Forging may be performed by a user (e.g. a blacksmith) or by a machine (e.g. free forging). It is also possible to use a rotary forge press to deform the casting.

It is convenient to perform the forging process progressively (i.e. sequential blows that each cause a small deformation) so that the deformations may crystallize without forming any cracks.

In some cases, rolling and forging may be both performed sequentially on a casting.

In some embodiments of the invention, the method further comprises (e) solution annealing the bar or workpiece at a temperature between 870° C. and 1010° C. (the endpoints being included in the range of possible values).

In order to reduce the hardness of the bar or workpiece and increase its ductility, the bar or workpiece may be subject to solution annealing. Moreover, solution annealing may reduce internal stresses of the bar or workpiece as well. The bar or workpiece is, thus, heated above its recrystallization temperature, maintained during some time at a temperature higher than said recrystallization temperature, and then it is rapidly cooled (e.g. quenching with water).

In some embodiments of the invention, step (e) is performed on the pretubular-shaped workpiece or cylindrical bar, that is, the solution annealing step may be performed after hot working the casting and before trepanning the bar or machining the pretubular-shaped workpiece such that the increase in ductility achieved with the plastic deformation is further improved.

In some embodiments, step (e) is performed on the tubular workpiece, that is, after trepanning and before cold working since with the increase in ductility, the wall reduction and lengthening of the tubular product during the cold working process may be enhanced and, thus, it is possible to apply a greater reduction in a single pass.

After cold working, the tube produced may feature a yield strength greater than 960 MPa owing to the reductions in wall thickness with the cold working process.

Since cold working may generate stresses within the workpiece, the solution annealing step may be performed after cold working as well so that it removes, at least partially, these inner stresses. In this case, the yield strength diminishes and the tube may feature a yield strength ranging from 415 MPa up to 750 MPa but, in contrast, the grain size may be refined and the homogeneity of the microstructure may be enhanced.

This grain refinement and enhancement of the homogeneity of the microstructure may be controlled: the grain size observed after solution annealing may be in the range from 15 microns to 75 microns by adjusting the temperature of the process so that the result of the following formula is between 2 and 6:

$$Red*9-\exp(100/T);$$

wherein Red is the reduction applied by the cold working in percentage—between 0 and 1—, and T is the temperature in degrees Celsius.

In preferred embodiments of the invention, cold working comprises one of: flow forming and pilgering.

In the embodiments in which cold working comprises flow forming, a flow forming machine which includes, inter alia, a mandrel and a plurality of rollers with, typically, three or four rollers, reduces the thickness of the walls of the workpiece and makes the workpiece longer. The tubular workpiece may be subject either to forward flow forming or reverse flow forming.

The tubular workpiece is attached to the mandrel by means of the hole, for instance formed with the trepanning or machining of step (b). When the workpiece is secured, the mandrel may move the workpiece in a movement direction of the rollers. The rollers apply forces to the workpiece in the axial, longitudinal and tangential directions. The compressive force in a radial direction reduces the wall thickness, which combined with the forces in the other two directions results in a lengthening of the workpiece or tube.

Flow forming may improve the grain structure of the tubular workpiece or tube making the inner structure more homogeneous throughout the whole workpiece, and which may enhance its mechanical properties.

In the embodiments in which cold working comprises pilgering, a pilger mill may reshape the workpiece into an elongated tube with thinner walls. The ring dies of the mill, which may be ring-shaped, compress the workpiece in a radial direction and, thus, reduce its outer diameter. The mandrel, which may secure the workpiece using a hole of the workpiece—for instance formed with the trepanning or machining of step (b)—moves and rotates the workpiece, and may also reshape the inner diameter of the workpiece or tube.

The mandrel feeds and rotates the workpiece successively while two ring dies deform the workpiece, thereby causing a reduction of both the outer diameter and the thickness of the walls. The workpiece is first rotated coarsely (i.e. large angle variations, for example, about 60°) so as to deform the section that is currently processed by the dies, and then rotated finely (i.e. small angle variations, for example, about 20°) to adjust the shape of the section such that it features a polished circular section, that is, a substantially rounded outer diameter.

Pilgering is a semi-continuous process that is particularly efficient in long run productions. The tubular workpiece may be fed, in a forward motion, at a rate between 2 mm/s and 50 mm/s (the endpoints being included in the range of possible values), whereas the feed rate or forward motion rate of the flow forming machine may be between 0.5 mm/s and 10 mm/s (the endpoints being included in the range of possible values). Even though the feed rate in the flow forming machine may be lower than in the pilgering one, a lower number of passes may be necessary to produce a tube with flow forming.

In some embodiments of the invention, flow forming or pilgering at least reduces the workpiece's wall thickness between 35% and 50% (the endpoints being included in the range of possible values).

In some embodiments of the invention, flow forming or pilgering at least reduces thickness of walls of the tubular workpiece between 50% and 75% (the endpoints being included in the range of possible values).

In some embodiments, the cold working comprises flow forming, and the flow forming at least reduces the wall thickness by 70% in one pass.

Due to the mechanical properties achieved after some processes or steps of some embodiments of the invention, the workpiece may support a wall reduction between 65% and 70% (the endpoints being included in the range of possible values) in a single pass with respect to the original thickness, that is, the wall thickness before flow forming and after the workpiece has been trepanned or machined. The original wall thickness is computed as the difference between the outer diameter and the inner diameter prior to cold working the workpiece. The wall reduction percentage is computed as the difference between the wall thicknesses after the reduction and before the reduction, divided by the original thickness.

With such reductions, the flow forming machine takes less time to process the workpiece and reduce the number of passes needed to achieve the desired thickness. This is even more significant considering that cold working progressively reduces the ductility of the workpiece after each pass or deformation produced and, hence, the forces necessary to further deform the workpiece increase.

With cold reductions greater than 35%, a yield strength greater than 960 MPa may be achieved; generally, a greater wall reduction implies a greater yield strength.

Another aspect of the present invention relates to nickel-based alloy tubes produced with the method described above with respect to the first aspect of the invention.

The tube comprises:

an outer diameter greater than or equal to 60.3 mm, preferably greater than or equal to 88.9 mm, and preferably greater than or equal to 114.3 mm; and an average wall thickness greater than or equal to 2.8 mm, and less than or equal to 70 mm, preferably greater than or equal to 5 mm, and preferably greater than 8 mm.

The tube may further comprise a length greater than 5 m. In some embodiments, the tube features a length greater than or equal to 10 m, and in some cases even greater than 12 m.

In some embodiments of the invention, the tube is made of a nickel-based alloy at least comprising nickel and chromium. Preferably, the nickel-based alloy is alloy 625.

In some embodiments, the tube is characterized by a microstructure comprising grains with an average size greater than or equal to 15 microns and less than or equal to 75 microns.

The average grain size is measured according to the ASTM E112 standard which sets forth a method for determining average grain size of metals.

In some embodiments of the invention, the tube is characterized by a yield strength greater than or equal to 415 MPa and less than or equal to 750 MPa. In some other embodiments, the tube is characterized by a yield strength greater than 750 MPa, and preferably greater than 960 MPa.

When the yield strength of the tube ranges from 415 MPa to 750 MPa, the tube features a greater resistance to corrosion which is advantageous in environments characterized by significant presence of hydrogen sulfide. A tube characterized by a larger yield strength like, for instance, a yield strength greater than 960 MPa, is less corrosion resistant but has an enhanced mechanical strength which is convenient for supporting higher pressures.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

DESCRIPTION OF A WAY OF CARRYING OUT THE INVENTION

Figure 1A:
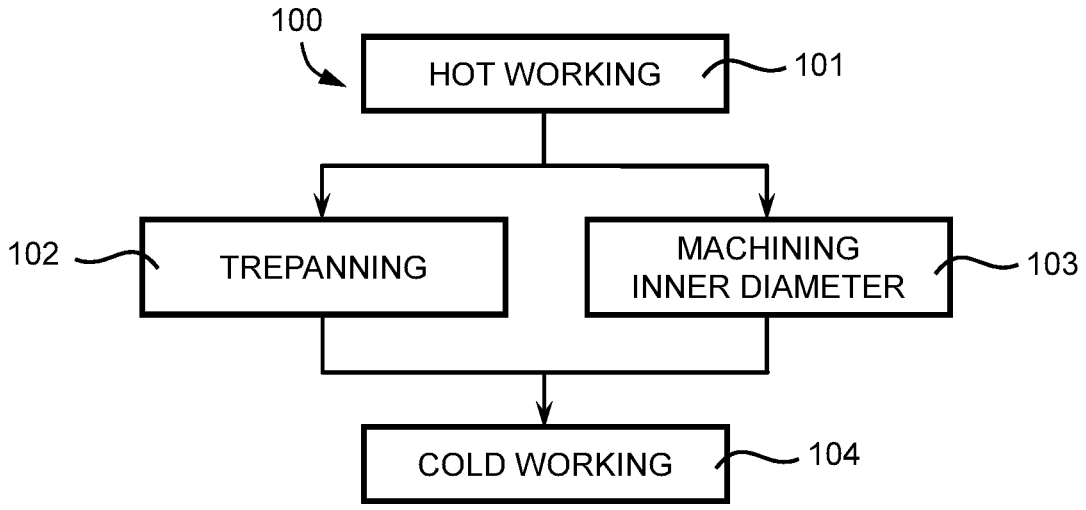
FIGS. 1A and 1B are flowcharts of methods in accordance with some embodiments of the invention.

FIG. 1A is a flowchart 100 depicting the steps carried on a method in accordance with an embodiment of the invention.

In step 101 of the method, a nickel-based alloy casting is hot worked into a pretubular-shaped workpiece or cylindrical bar, namely, the casting is plastically deformed in an environment that has a temperature higher than the casting's recrystallization temperature so that its internal structure is altered. Generally, the casting has a microstructure including differently-sized grains, material segregations, and cavities that appear during its casting. Hot working, that is, plastically deforming the casting, reduces the aforementioned defects within the resulting workpiece or bar since a new crystalline structure may be formed. This structure may be characterized by a more homogeneous distribution of grains, and a lower presence of cavities and/or alloy segregations. Consequently, the amount of internal stresses is lower, which improves some mechanical properties of the workpiece or bar; the ductility, for instance, may increase due to the hot working of step 101.

Some non-limiting examples of hot working are forging, rolling and drawing.

When the casting is hot-worked into a cylindrical bar, the bar is trepanned in step 102. A drilling or cutting machine drills a hole into the cylindrical bar, preferably a through hole with circular cross section. In the embodiments in which hot working—step 101—produces a pretubular-shaped workpiece, the workpiece is subject to a machining process of its inner diameter in step 103. After step 102 or step 103, a tubular workpiece is obtained.

In step 104, the tubular workpiece is cold worked: the workpiece is plastically deformed at a temperature below its recrystallization temperature. Particularly, in step 104 the walls of the workpiece are reduced and the length of the tube produced is increased.

Some non-limiting examples of cold working are pilgering and flow forming. In these cases, the mandrel of the flow forming or pilgering machine holds the workpiece by means of the hole formed in step 102 or machined in step 103 so that the tubular workpiece may be subject to the deformations produced by the machine.

Figure 1B:
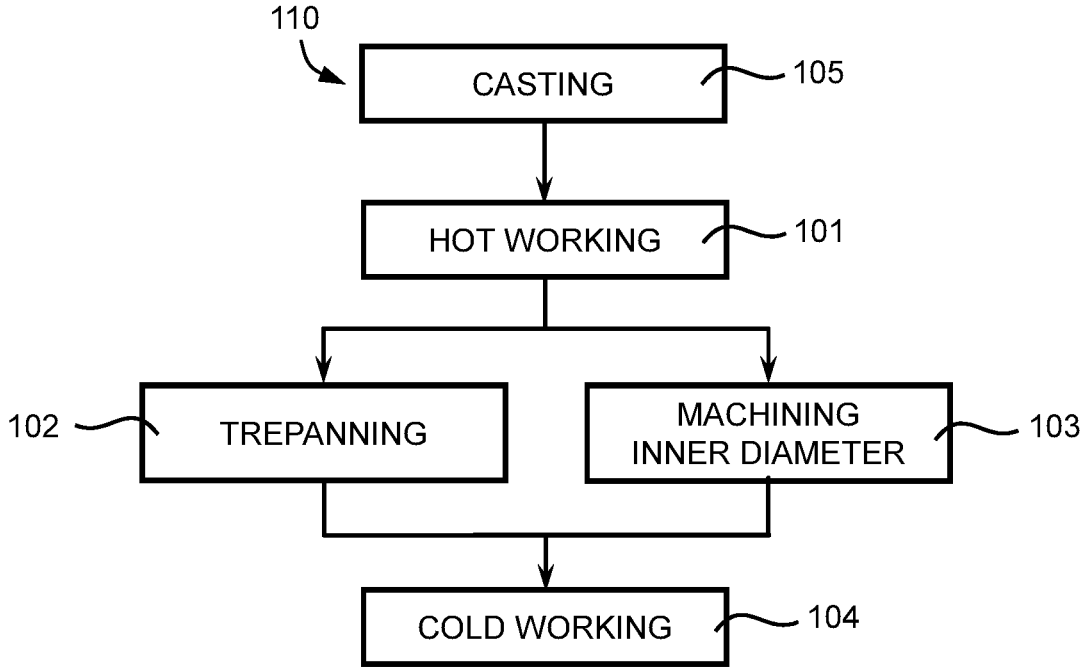

FIG. 1B is a flowchart 110 that depicts the steps of a method for producing a tube in accordance with another embodiment.

The flowchart 110 comprises steps 101, 102, 103 and 104 corresponding to hot working, trepanning, machining and cold working, respectively, as described above with respect to flowchart 100.

The method of FIG. 1B further comprises step 105: casting, by which a nickel-based alloy is melt and poured in a mold. The nickel-based alloy is left to dry forming the casting, which may take the shape of, for example, an ingot or a bar. The volume of alloy in the casting may determine the maximum amount of alloy which may be used for producing the tube since, generally, no alloy is added afterwards, rather, some alloy is removed during one or more of the successive steps 101-104 of the method.

Then, the casting is at least subject to hot working (step 101), trepanning (step 102) or machining of the inner diameter (step 103), and cold working (step 104).

The casting and/or workpiece subject to the methods described with respect to flowcharts 100, 110 comprise a nickel-based alloy, the nickel-based alloy being an alloy comprising nickel and, in some embodiments, chromium as well. In some embodiments, the nickel-based alloy is alloy 625 corresponding to UNS N06625, which comprises a particular composition of nickel, chromium, molybdenum and columbium.

The tubes produced in some of these embodiments feature a length longer than 5 m. In some of these embodiments, the length of the tubes produced is longer than 10 m. And in some of these embodiments, the length of the tubes produced is longer than 12 m. These tubes may feature an outer diameter greater than or equal to 60.3 mm, preferably greater than or equal to 88.9 mm, and preferably greater than 114.3 mm; the tubes may also feature an average wall thickness greater than or equal to 2.8 mm, and less than or equal to 70 mm, and preferably greater than or equal to 5 mm and less than or equal to 8 mm.

Figure 2:
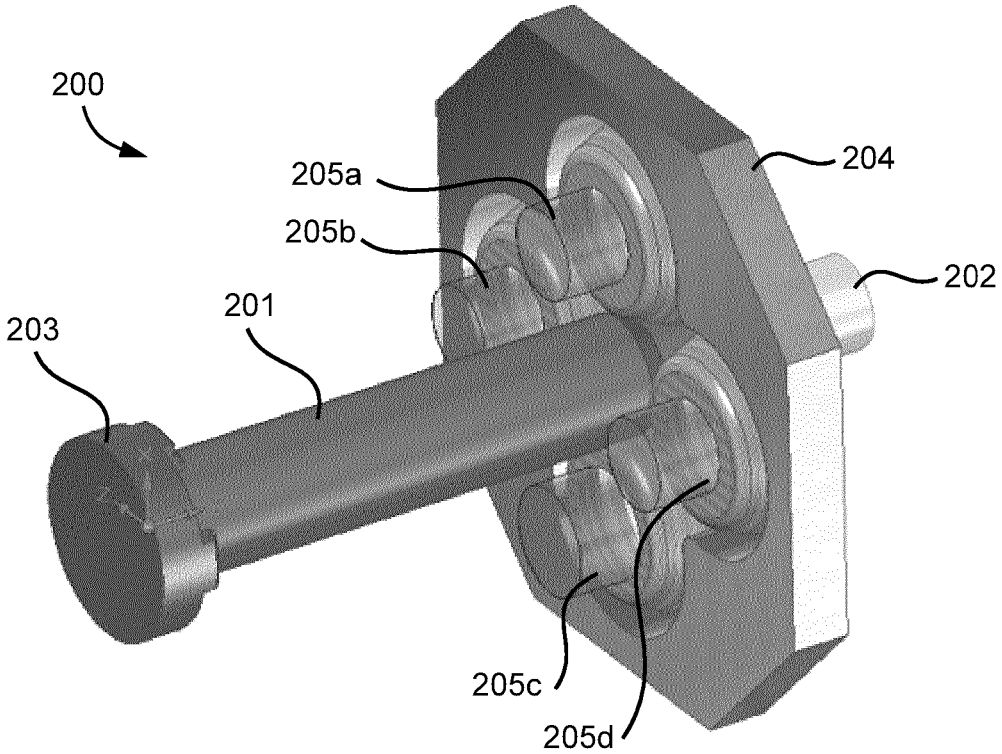
FIG. 2 is a representation of a flow forming machine, which may be used for cold working in some embodiments of the invention.

FIG. 2 shows a flow forming machine 200. A workpiece 201 having a tubular geometry is placed on the mandrel 202 of the machine, and held in place with a jaw chuck 203. The jaw chuck 203 makes the workpiece 201 rotate in accordance with the rotary motion of the mandrel 202—an engine (not illustrated) provides said rotary motion—. The machine 200 further comprises a carriage 204 in which a plurality of rollers 205*a*-205*d* are arranged in an equidistant configuration with a progressive 90° phase difference between the rollers 205*a*-205*d*.

Both the mandrel 202 and the plurality of rollers 205*a*-205*d* feature rotary movements during the operation of the machine 200 such that the workpiece 201, as it goes through the set of rollers 205*a*-205*d*, has its outer diameter reduced, which in turn causes a reduction of the thickness of its walls, and its length increased—along the Y axis illustrated in the figure.

In the flow forming machine 200, there are up to 10 degrees of freedom which are adjusted and controlled during the production of tubes: the rotation of the mandrel 202, the rotation of each of the four rollers 205*a*-205*d*, the position of each of the four rollers 205*a*-205*d* relative to the workpiece 201 or mandrel 202—horizontal position adjustments of rollers 205*b* and 205*d*, and vertical position adjustments of rollers 205*a* and 205*c*—, and the distance of the portion of the mandrel between the jaw chuck 203 and the carriage 204.

In some embodiments, the flow forming machine comprises two, three, six or more rollers and, consequently, the machine may feature more or less degrees of freedom. In these other embodiments, the rollers may also arranged following constant phase differences with respect to an imaginary circumference along which the rollers are distributed; the constant phase differences correspond to 360° divided by the number of rollers in the carriage.

The carriage 204 moves towards the jaw chuck 203, and the rollers 205*a*-205*d*, which rotate in a direction contrary to the rotary movement of the mandrel 202 and the workpiece 201, provide forces in the axial, radial and tangential directions. Although the rollers apply a compressive force on the workpiece 201, the carriage 204 must cope with and resist the forces applied by the rollers 205*a*-205*d*. Thus these forces—mainly those in the axial and radial directions, since the tangential component is much smaller than the other two—determine the structural requirements of the carriage 204.

The rollers can be offset axially to each other which allows three different roll configurations, depending on the requirements of the process. An axial offset to zero-line allows faster forming feed rates. An axial offset that is four times different, one for each roller, allows higher accuracy and perfect surface qualities combined with high reduction rates. The middle way, a pair wise axial offset allows stronger flow forming operations which means higher reductions, because each forming roller of the pair works as a counter-bearing and takes the force of the opposite roller. The result is a perfect run-out at high feed rates.

Figure 3:
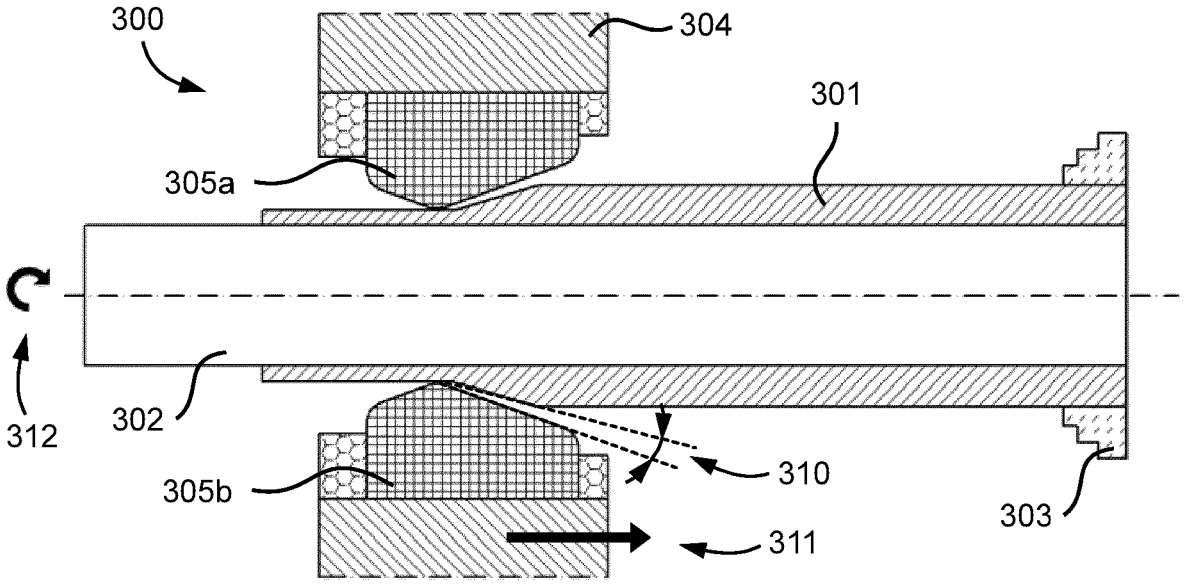
FIG. 3 is another representation of a flow forming machine.

FIG. 3 shows a flow forming machine 300 in a 2D view. Similarly to the machine 200 of FIG. 2, the mandrel 302 holds the workpiece 301, and the jaw chuck 303 also holding the workpiece 301 makes the workpiece rotate in accordance with the rotating motion of the mandrel 302.

As the carriage 304 moves towards the jaw chuck 303, the rollers 305*a*, 305*b* apply a compressive force to the workpiece 301 and incrementally produce a tube longer and with thinner walls.

The existence of so many degrees of freedom in the flow forming machine—and, by extension, the corresponding process—makes its operation a complex task. To this end, a computer numerical control manages the whole process and operation such that the produced tubes feature, throughout their whole volume, the mechanical and microstructural properties sought in the lower number of passes possible. In this sense, the computer numerical control may adjust the parameters related to the aforementioned degrees of freedom so that the axial and radial forces of the rollers 305*a*, 305*b* plastically deform the inner part of the workpiece 201 so as to generate compressive forces within its structure.

It is of particular relevance to determine an appropriate ratio between the rate 311 at which the carriage 304 moves towards the jaw chuck 303 and the rotary speed 312 of the mandrel 302. If this ratio is too high, the rollers 305*a*, 305*b* may not properly deform the workpiece 301. Conversely, if the ratio is too small, the time it takes to process the workpiece 301 may be unnecessarily long.

It is also convenient to adjust the angle of attack 310 of the rollers 305*a*, 305*b*, that is, the relative angle between the rollers 305*a*, 305*b* and the workpiece 301 as it is being flow formed. The angle of attack 310 may range between 6° and 45° (the endpoints being included in the range of possible values). Too pronounced angles of attack may also result in irregular deformations of the workpiece 301.

Preferably, the end of the workpiece 301 that will be first in contact with the rollers 305*a*, 305*b* has the edges of its opening chamfered so that the rollers do not deform the workpiece irregularly, which could render the tube unusable since the mechanical properties of that part of the tube may differ from the rest of the tube.

The flow forming not only reshapes the workpiece, it also changes its microstructure: the resulting grains may be oriented and have a homogeneous fine size, both of which provide improved mechanical properties.

Figure 4A:
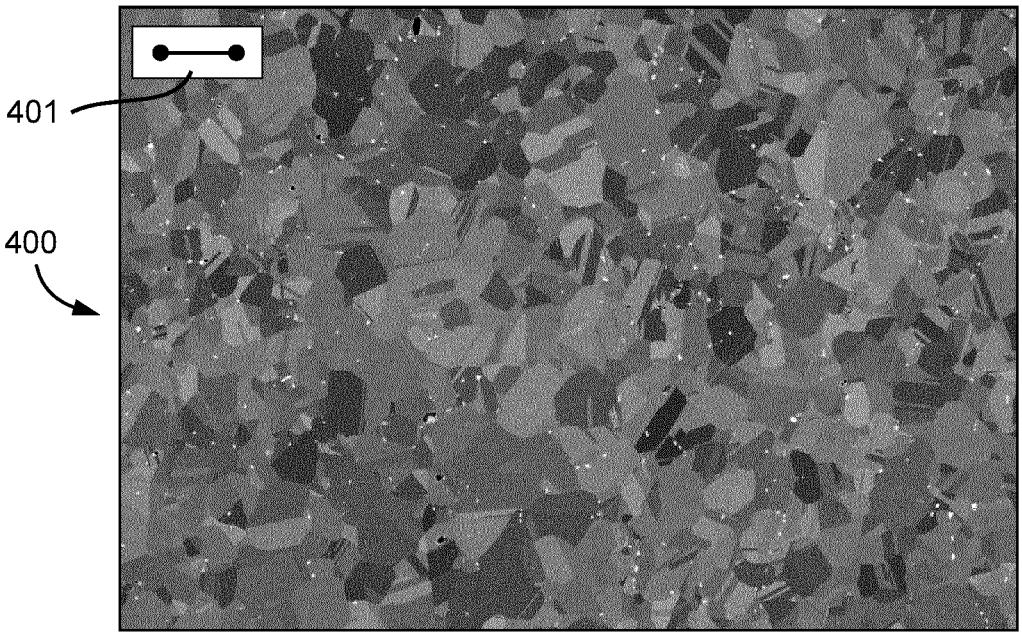
FIGS. 4A and 4B are photographs of the microstructure of a tube after a solution annealing step.

FIG. 4A is a photograph that shows the microstructure 400 of a tube comprising alloy 625 produced with a method in accordance with an embodiment of the invention. Particularly, the tube has been formed after hot working an alloy 625 casting, machining the inner diameter of the pretubular-shaped workpiece, cold working the tubular workpiece with flow forming, and performing a solution annealing process at 870° C.—i.e. degrees Celsius—. It may be observed that the size of the grains is in the order of tens of microns as seen by comparison with the reference magnitude 401 equivalent to 100 micrometers.

Figure 4B:
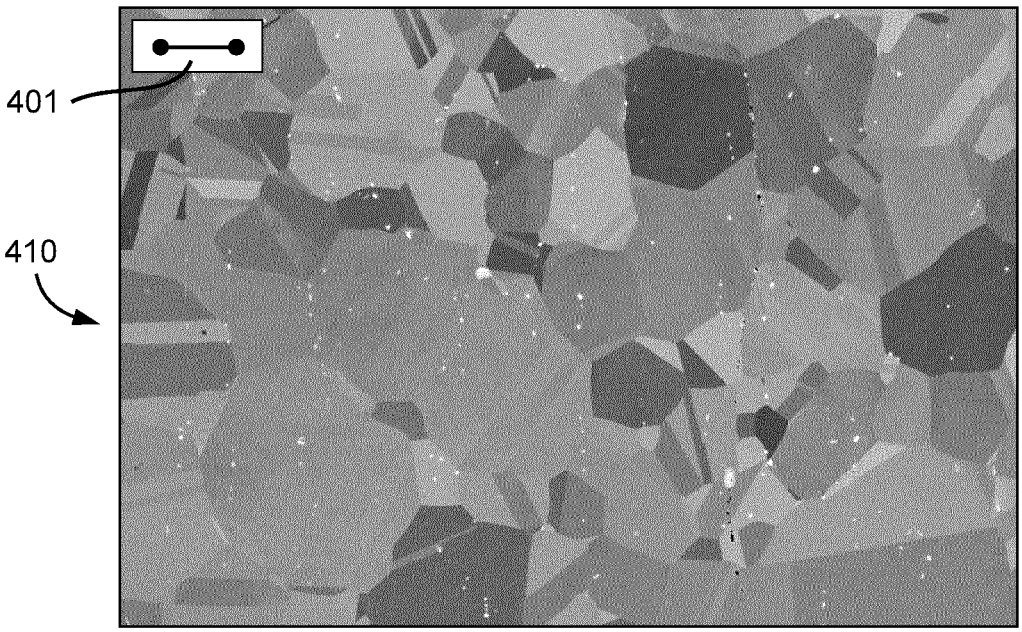

The size of the grains is relatively larger in the microstructure 410 shown in FIG. 4B. In this case, the method is the same as the one carried out for the microstructure 400 of FIG. 4A but the temperature in the solution annealing step is 1010° C., thus the size of the grains is in the order of the hundreds of microns.

In this text, the term "comprises" and its derivations (such as "comprising", etc.) should not be understood in an excluding sense, that is, these terms should not be interpreted as excluding the possibility that what is described and defined may include further elements, steps, etc.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A method for producing a tube of a nickel-based alloy, the method comprising:

(a) hot working a nicked-based alloy casting into a pretubular-shaped workpiece or into a cylindrical bar;

(b) trepanning the cylindrical bar or machining an inner diameter of the pretubular-shaped workpiece to obtain a tubular workpiece; and (c) cold working the tubular workpiece.

2. The method as claimed in claim 1, wherein:

the method further comprises (d) casting the nickel-based alloy casting; and (d) is performed prior to (a).

3. The method as claimed in claim 1, wherein the nickel-based alloy is an alloy at least comprising nickel and chromium.

4. The method as claimed in claim 1, wherein the nickel-based alloy is UNS N06625.

5. The method as claimed in claim 1, wherein the hot working comprises one of: rolling, forging, and a combination thereof.

6. The method as claimed in claim 1, further comprising (e) solution annealing the pretubular-shaped workpiece or cylindrical bar, at a temperature between 870° C. and 1010° C.

7. The method as claimed in claim 1, further comprising (e) solution annealing the tubular workpiece, at a temperature between 870° C. and 1010° C.

8. The method of claim 7, wherein (e) is performed in at least one of the following:

after (b) and prior to (c); and after (c).

9. The method as claimed in claim 1, wherein the cold working comprises one of: flow forming and pilgering.

10. The method of claim 9, wherein the cold working comprises flow forming, and the flow forming at least reduces thickness of walls of the workpiece by 70% in one pass.

11. The method as claimed in claim 1, wherein trepanning the cylindrical bar or machining an inner diameter of the pretubular-shaped workpiece to obtain a tubular workpiece comprises trepanning the cylindrical bar to obtain a tubular workpiece.

12. The method as claimed in claim 1, wherein the method comprises a single step (c) cold working the tubular workpiece.

13. The method as claimed in claim 1, wherein:

hot working the nicked-based alloy casting into the pretubular-shaped workpiece or into the cylindrical bar comprises hot working the nicked-based alloy casting into the pretubular-shaped workpiece; and trepanning the cylindrical bar or machining an inner diameter of the pretubular-shaped workpiece to obtain a tubular workpiece comprises machining the inner diameter of the pretubular-shaped workpiece to obtain the tubular workpiece.

14. The method as claimed in claim 1, wherein the tubular workpiece exhibits:

(a) an outer diameter greater than or equal to 60.3 mm; and (b) an average wall thickness greater than or equal to 2.8 mm, and less than or equal to 70 mm.

15. The method as claimed in claim 14, wherein the tubular workpiece is characterized by a yield strength greater than or equal to 960 MPa.

16. The method as claimed in claim 14, wherein the tubular workpiece is characterized by a yield strength greater than or equal to 415 MPa and less than or equal to 750 MPa.

17. The method of claim 14, wherein the tubular workpiece exhibits a length greater than 5 m.

18. The method of claim 17, wherein the tubular workpiece is characterized by a microstructure comprising grains with an average size greater than or equal to 15 microns and less than or equal to 75 microns.

* * * * *